US006518001B2

(12) United States Patent
Twist

(10) Patent No.: US 6,518,001 B2
(45) Date of Patent: Feb. 11, 2003

(54) PROCESSING PHOTOGRAPHIC MATERIAL

(75) Inventor: Peter J. Twist, Buckinghamshire (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/961,529

(22) Filed: Sep. 24, 2001

(65) Prior Publication Data

US 2002/0081537 A1 Jun. 27, 2002

(30) Foreign Application Priority Data

Nov. 3, 2000 (GB) ..... 0026952

(51) Int. Cl.[7] ..... G03C 5/26; G03C 7/30
(52) U.S. Cl. ..... 430/401; 430/403; 430/418
(58) Field of Search ..... 430/401, 403, 430/418, 423, 427

(56) References Cited

U.S. PATENT DOCUMENTS

| | | | | | |
|---|---|---|---|---|---|
| 2,947,236 | A | * | 8/1960 | Siegel | 396/589 |
| 3,693,529 | A | * | 9/1972 | Stabler | 396/588 |
| 3,705,544 | A | * | 12/1972 | Ratowsky | 366/166.1 |
| 3,982,259 | A | * | 9/1976 | Van Baerle | 366/131 |
| 5,234,802 | A | * | 8/1993 | Nakamura et al. | 396/45 |

FOREIGN PATENT DOCUMENTS

| | | |
|---|---|---|
| NL | 288055 | 6/1965 |

* cited by examiner

*Primary Examiner*—Hoa Van Le
(74) *Attorney, Agent, or Firm*—Frank Pincelli

(57) ABSTRACT

A method of processing photographic material in which a fixed volume of processing solution is added to the surface of the material and spread repeatedly over the length of material. The processing solution is added to the material in at least two stages.

18 Claims, 2 Drawing Sheets

PROCESSING PHOTOGRAPHIC MATERIAL

FIELD OF THE INVENTION

This invention relates to a method and apparatus for processing photographic material. In particular, the invention relates to a method of processing which uses a low volume of processing solution.

BACKGROUND OF THE INVENTION

Conventional processing of photographic material requires the use of large tanks of processing solutions. Each tank contains a processing solution such as developer, bleach, fixing solution or washing solution. The material is transported through each tank in turn. There is a tendency for the solutions to carry over from one tank to another leading to pollution of the solutions. Conventional processing has several other drawbacks. The temperatures which can be utilized are limited and therefore the process is slow. The composition of the solutions must be stable over long time periods in the processing tanks. Replenishment of the solutions is difficult to control. The processing apparatus is also very large due to the number of processing tanks.

To overcome the problems of conventional deep tank processing surface application of the processing chemicals was developed. In previous surface application methods a volume of solution is applied to the surface of the material being processed. However, previous surface application methods have several drawbacks. If the solution applied to the material is just left on the material in a static condition the processing will be very slow and inefficient because there is no agitation and by-products accumulate in the material layers and slow down processing. This method is also prone to non-uniformity of processing.

It is also known to process the material within a rotary tube. The material to be processed is placed emulsion side facing inwards within the tube. Solution is added and the tube rotated. Large volumes of processing solution (70 ml/sq.ft and upwards) will process the material effectively so long as rotation is not so fast as to cause dispersion of the solution puddle. Rapid rotation of the device is however very desirable to quickly and evenly distribute a given small volume of solution over the whole surface of the material so that processing is uniform from one end to the other. If the rotation is too slow there will be seasoning of the small volume of solution by the front end of the material and processing will be different at the back end of the material. Small volumes of processing solution (50 ml/sq.ft or less) do not properly process film or paper because when the device is rotated, even at low speeds of rotation, the solution puddle is dispersed and spread over the whole surface of the material. Consequently there is no agitation. This leads to several processing defects. Processing is streaky, non-uniform and also slow because of local consumption and the accumulation of by-products. There is no surface mixing and chemical economy is therefore low.

Co-pending application no GB 0023091.2, filed on Sep. 20, 2000, discloses a single use wave processor and method of processing that employs volumes per linear foot of film that are similar to those used for replenishment of conventional deep tank processors. The wave processor uses these volumes and then disposes of them and therefore eliminates the need for standing tanks of solution. Processing solutions can be added directly to the processing chamber of the wave processor and a process cycle can consist of developer, stop, solution removal, bleach, solution removal, fix, solution removal and four wash stages with solution removal between stages. In this case solution removal is by vacuum suction of about 85% of the previous processing solution before the next one is added. This means a complete process is run in one processing vessel.

Processing solutions such as the developer can have a limited lifetime due to aerial oxidation and evaporation. In conventional processing machines in which developer-replenisher is used the developer-replenisher also has a limited lifetime. In Kodak SM processors the limited lifetime of these processing solutions has been overcome by using direct replenishment with concentrates. C-41 film developer has three concentrates which are metered into the developer tank at a rate proportional the amount of film processed. This maintains the developer solution at optimum composition.

In the case of the wave processor it is desirable to use similar concentrates to those used in the C-41 process. However, there is no developer solution and no bleach solution and no fixer solution in the processing vessel to add the concentrates to. The wave chamber is empty at the start of the process. In addition it is necessary to load the film into the processing space before the solutions are added. Adding concentrates directly on the film might cause processing uniformity problems. Furthermore it is desired to develop in about 30 seconds which leaves little time for mixing. If a film designed for the C-41 process which has a development time of 3 minutes 15 seconds is processed under more active conditions in 30 seconds it is found that the red and green contrasts are low compared to the blue contrast. These problems are overcome by the invention and additional benefits of the invention are also demonstrated.

SUMMARY OF THE INVENTION

It has been found that by adding a concentrate consisting of most of the components of the developer solution except the color developing agent directly to the film surface, leaving for a short time, then adding another concentrate consisting mainly of the color developing agent, that excellent photographic performance can be obtained. In comparison with a process in which a single pre-made developer solution, which is made from the same concentrates, is added to the film, a better photographic performance results from the two stage method.

According to the present invention there is provided a method of processing photographic material comprising the steps of applying a fixed volume of at least one of the processing solutions to the surface of the material such that the volume is spread and re-spread repeatedly over a given length of material in a rotating containment chamber, the fixed volume being applied in at least two stages, in the first stage the first volume is spread repeatedly by the formation of a standing wave of solution, in the second stage the second volume is added to the standing wave so as to mix coherently with the first volume, each stage lasts for a predetermined time period. Preferably the solution is agitated as it is applied to the surface of the material.

The photographic performance of two stage development is superior to that of the one stage development, for the same development time and the same chemical usage.

The method of the invention allows direct mixing of the component parts of a given processing solution in the processing chamber while the film is present.

The separated developer components used in two stage development are much more stable than the pre-mixed developer used in single stage development. Such components can therefore be stored for much longer time periods.

The method of the invention allows the material being processed to be wetted and partly swollen by the first or buffer stage of the process, before development starts. The buffer components of the developer are added first and it is thought that this allows the pH of the emulsion layers of the film to be closer the development pH before development starts compared with the case where development starts immediately. This is thought to be particularly true for the lowest or red emulsion layer.

The ratio of the two component parts of the two stage development process can be changed at will. Therefore the composition of the developer can be "fine tuned" for the particular material being processed. It is also possible to vary the relative treatment times of the first and second stages of the two stage development to allow "fine tuning" of the development to a particular film.

BRIEF DESCRIPTION OF THE DRAWINGS

The invention will now be described, by way of example, with reference to the accompanying drawings, in which.

DETAILED DESCRIPTION OF THE INVENTION

Figure 1B:
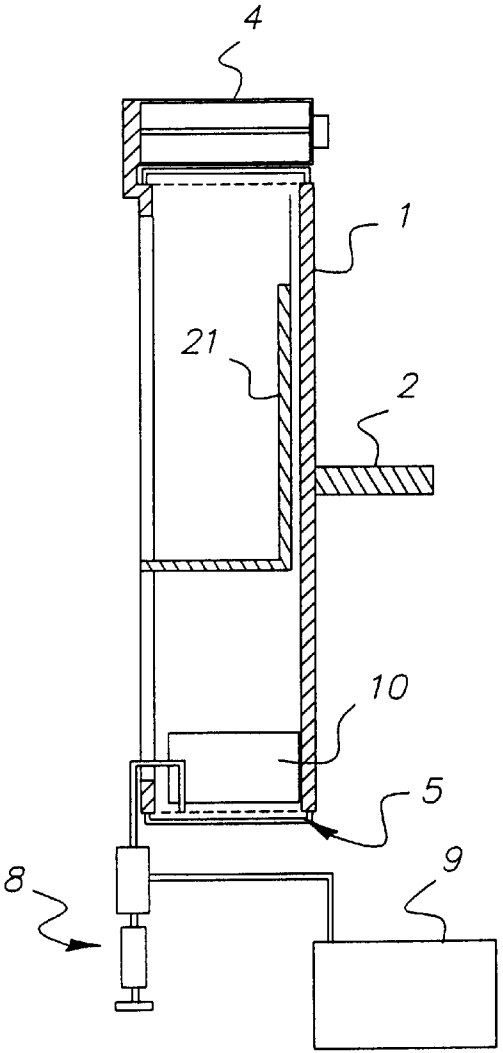
FIGS. 1A and 1B show a schematic side view and a section view respectively of an apparatus for performing the invention.
Figure 1A:
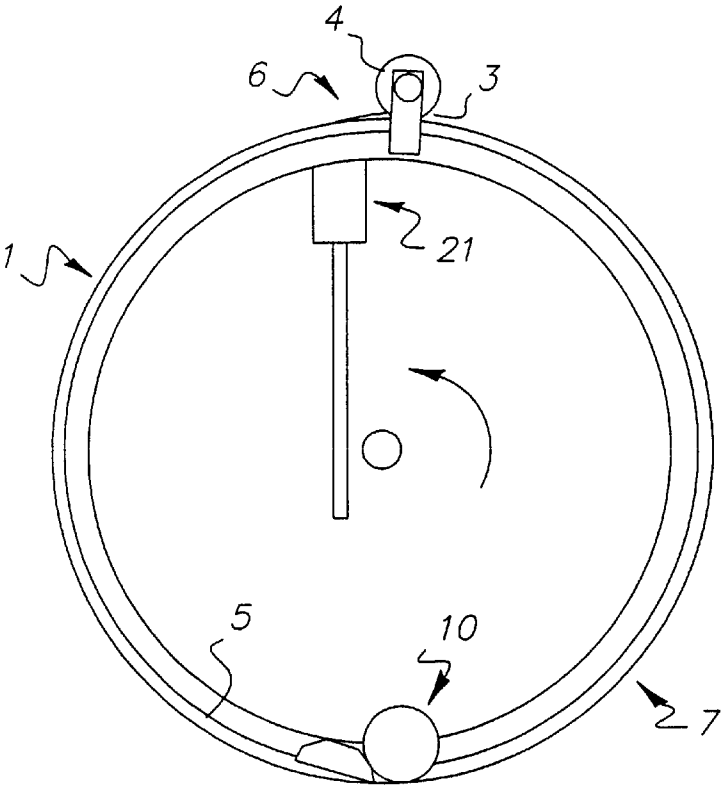

FIGS. 1A and 1B show a wave processor in which the method of the invention may be performed.

The wave processor comprises a cylinder 1 having at least one open end. The cylinder may be made of stainless steel, plastics or any other suitable material. A transparent material, such as polycarbonate, may be used if it is desired to scan the material while it is within the cylinder. The cylinder defines a processing chamber. An arm 3 is provided on the outer side of the cylinder for holding a film cassette 4. A slot 6 with a water tight cover (not shown) is provided through the wall of the cylinder to allow the strip of film 5 from the film cassette to enter the processing chamber. The watertight cover may be in the form of a hinged door having a rubber wedge. However, any suitable means may be used. A circular slot is defined around the inner circumference of the chamber for holding the strip of film 5 by the edges.

A second arm 21 is located within the chamber. This arm 21 grabs the tongue of the film and holds it against the inner circumference of the chamber.

A close fitting cover (not shown) may be provided around the inner circumference of the chamber which sits above the film surface by at least 0.5 mm. This cover provides at least three functions to improve the performance of the apparatus. Firstly it lowers water evaporation which can cause a temperature drop and can concentrate the processing solution as processing is occurring. Secondly it can itself provide agitation by maintaining a puddle of solution in the gap between the cover and the film surface at the lowest point of the chamber. Thirdly it provides a film retaining means making edge guides unnecessary, although edge guides can be also be provided to prevent the film sticking to the cover. It allows both 35 mm film and APS film (24 mm) to be loaded in the same apparatus and it also allows any length of film to be loaded. The material of the cover can be impervious to processing solution and as such is provided with a break or gap in its circumference so that the two extreme ends of the cover do not meet and through which processing solution is added to the film surface. The cover may be fixed and rotate with the chamber as the chamber rotates. Alternatively the cover may not be fixed and rests on rails on each side which allow the cover to slide and remain stationary as the chamber rotates. In this case the cover is again provided with a break or gap in its circumference so that processing solutions can be added to the film surface. Alternatively the cover can be made of a material which is porous to processing solution such as a mesh material or a material punctured with holes. The cover can be made of plastic, metal, or any suitable material.

A drive shaft 2 is provided at the closed end of the cylinder for rotation thereof. The open end of the cylinder 1 is provided with a flange 7. The flange retains solution within the chamber. In the apparatus shown in FIG. 1B the processing solutions are introduced into and removed from the chamber by means of syringes 8. However any suitable means may be used, for example metering pumps. The solutions may be introduced from a reservoir 9. Alternatively the solutions may be held in a cartridge prior to use. The cartridge can consist of part or all the processing solutions required to complete the process and is easily placed or "plugged in" the processor without the need to open or pour solutions. The cartridge can consist of an assembly of containers for each of the solutions required for the process. The solutions may be removed by suction or any other means. Residue of solutions therefore do not build up within the processing chamber. This results in the processing chamber being essentially self cleaning. The cross over times from one solution to another are very short.

A wave forming mechanism is provided within the processing chamber. This wave forming mechanism sweeps the film surface and forms a wave of solution, primarily at the lowest point in the chamber. In the apparatus shown in FIG. 1 the mechanism is a free standing roller 10. It is possible that this roller may be held on a loose spindle, (not shown), which would allow the roller to be steered and also to be raised and lowered into position. The position of the roller can be changed with this mechanism so that it is to the left or right of bottom dead centre which can be advantageous for the smooth running of the roller. It is also desirable to raise or lower the roller which might facilitate film loading.

In operation a film cassette 4 is located in the arm 3 and held on the outside of the cylinder 1. The end of the film 5 is withdrawn from the cassette and entered into the processing chamber by means of the slot 6. The arm 21 holds the film against the inner circumference of the cylinder and the cylinder 1 is rotated so that the film 5 is unwound from the cassette and loaded into the processing chamber. The film is held in a circular configuration within the processing chamber. This loading is carried out while the processing chamber is dry although it is also possible to load the film if the chamber is wet. The film is held with the emulsion side facing inwards with respect to the chamber. It is also possible to load the film with the emulsion side facing outwards provided a gap is present between the film surface and the inner circumference of the chamber. Once loaded, the film is held by the edges thereof within the circular slot around the circumference of the chamber.

The processing chamber is heated. The chamber can be heated electrically or by hot air. Alternatively the chamber may be heated by passing the lower end thereof through a heated water bath. The chamber is then rotated. When the desired temperature is reached a given volume of a first processing solution is introduced into the chamber. The processing solution may be heated prior to being introduced into the chamber. Alternatively the solution may be unheated or cooled. As the chamber rotates the film is continuously re-wetted with the given volume of solution.

Processing solution is added onto the roller 10 which is contacted across the whole width thereof by a spreader. The spreader may be made of flexible soft plastic, rigid plastic or any other suitable material. The roller 10 rotates in contact with the spreader. Processing solution is delivered, via a supply pipe, down the spreader to the region of contact between the roller and the spreader. This delivery method forms a uniform bead of solution over the region of contact between the roller and the spreader which extends across the width of the roller 10. This allows uniform spreading of the processing solution onto the film 5 as it passes under the roller 10. It is also possible to add solutions very quickly by "dumping" a given volume into the chamber while it is rotating so that it immediately forms a "puddle" or wave in front of the roller. Yet another method is to add the processing solutions when the chamber is stationary to a region where there is no film or to a region where there is no image such as the fogged end of the film. The rotation of the chamber is then started after the solution has been added. The time interval between adding the solution and starting the rotation can be from zero to any desired hold time.

The roller 10 acts as a wave forming mechanism. This wave forming mechanism, in combination with the rotation of the chamber, provides very high agitation which gives uniform processing even with very active processing solutions. High agitation and mixing are required when only small volumes of solution are being used, in the order of about 0.5 ml. If a large volume of solution is added to the chamber in the absence of a wave forming mechanism a "puddle" of solution is formed and spreading and agitation is achieved. However if a small volume of solution is added to the chamber in the absence of a wave forming mechanism then solution adheres to the film as the chamber rotates. There is no "puddle" formed and there is consequently no agitation or mixing and processing is slow and non-uniform. The agitation and mixing mechanism of the present invention, i.e. the wave forming mechanism, is sufficient to minimize density differences from the front to the back of the film.

Once the first stage of the processing is completed most of the processing solution may be removed by suction. A given volume of the next processing solution is then introduced into the chamber and then removed after the desired time and so on. Finally, the wash solutions are added and removed. The normal mode of operation is to perform the complete process cycle within the single processing space of the rotating chamber. The process cycle may be develop, stop, bleach, fix and wash. The processing solution for each stage is added to the chamber and left for the required time. It is then removed and the next processing solution is added and left for the required time, and so on until the process cycle is complete. The film 5 may be dried in-situ with hot air. The whole process cycle may thus be carried out within a single processing space.

All the solutions can be added at one delivery point and it is preferable to add the solutions rapidly and to ensure that the volume added does not break-up into separate droplets. The maintenance of a discrete volume can be facilitated by "dumping" or "pouring" the solution through a wide tube which is situated close to the inner circumference of the drum chamber so that the solution has only a short distance to travel. In a processing stage which consists of two parts it is necessary that the second part is added to the existing "puddle" or wave of the first part. The method requires that at least the volume of the first part that is added is more than that absorbed by the film so that the volume can be spread and re-spread over the whole length of the film and so that a wave of solution can be formed by means of the wave forming mechanism. The volume of the second part can be more or can be less than that absorbed by the film since it is added on top of the first part. The solutions can be added when the drum chamber is rotating or when it is stationary. The drum chamber is essentially acting as a mixing chamber for the first part and the second part. It is thus possible to arrange more complex modes of addition where some fraction of the first part is added which is then mixed with the second part and finally the rest of the volume of the first part is added. Thus any fraction of the volume of the first part that is greater than the volume absorbed by the film can be mixed with any fraction of the volume of the second part and then the remaining volume of the first or second part can be added subsequently. Thus it can be advantageous to add sufficient volume of the first part to neutralize the acidity of the second part so that the solution within the drum chamber is in the pH range 5 to 9. This is particularly advantageous if the processing stage is the development stage since the majority of the components of the developer solution can be spread on the film without development occurring. The remainder of the first part or alkaline part is then added to start the development. The method and apparatus of the invention easily allows very complex sequences of solution addition similar to that described above which are not possible with methods and apparatuses in the prior art.

It is possible to vary the timing of the addition of the first part and the second part. Time $t_1$ is defined as the time between the addition of the first part and the addition of the second part and time $t_2$ is defined as the time between the addition of the second part and the addition of the solution for the next stage in the process cycle. The total time for the stage is $t_1+t_2$. The times $t_1$ and $t_2$ can be varied to any desired amount. The times $t_1$ and $t_2$ can also include a solution removal step or partial solution removal step which is started about five seconds before the end of times $t_1$ and $t_2$. More complex timings can be made if a fraction of the first part is used to neutralize the second part as described above.

It is also possible within the method of the invention to add the components of a particular stage in the process, such as the development stage, the bleach stage, the fix stage and the wash stage in more than two parts. The method and apparatus of the invention is particularly suited to perform such complex addition regimes because the solution addition station is in the same place for different solutions and solutions can be added and removed merely by activating delivery or removal pumps.

The method and apparatus of the invention allows all the advantages described above while still using small volumes similar to those used to replenish large standing tanks in conventional processing machines.

The method of the invention is described in more detail with reference to the following examples.

EXAMPLE 1

This is an example of the invention.

In Table 1 two process cycles are compared in which the developer stage in one case is a single solution and in the other case two solutions. The rest of the process is identical in each case and is the standard C-41.

TABLE 1

Two stage and single stage development

| | Process 1 | | Process 2 |
|---|---|---|---|
| Stage | part 1 | part 2 | single part |
| Developer | 5 sec | 25 sec | 30 sec |
| Stop | 30 sec | — | 30 sec |
| Bleach | 3 min 30 sec | — | 3 min 30 sec |
| Fix | 3 min 30 sec | — | 3 min 30 sec |
| Wash | 2 minutes | — | 2 minutes |

Where Bleach is Kodak Flexicolor Bleach III NR and fix is Kodak Flexicolor fixer and replenisher and the stop is 10% acetic acid. In Table 2 the composition of the single developer solution is shown plus the composition of the two concentrates. The two concentrates when mixed in the correct ratio combine to form the same composition as the single developer solution.

TABLE 2

Single and two part developer composition

| Developer | single part | two part (1) | two part (2) CD4 |
|---|---|---|---|
| Na2SO3(anhydrous) | 10.53 g/l | 10.81 g/l | |
| HAS | 3 g/l | 3.36 g/l | |
| DTPA | 2.6 g/l | 2.9 g/l | |
| PVP(K15) | 3 g/l | 3.36 g/l | |
| KI | 0.002 g/l | 0.0024 g/l | |
| NaBr | 2.8 g/l | 3.14 g/l | |
| K2CO3 | 40 g/l | 44.8 | |
| Na2S2O5 | 0 | 0 | 7 g/l |
| CD4 | 15 g/l | 0 | 140 g/l |
| pH | 10.48 | 12.84 | — |
| Photoflo | 40 drops/l | 40 drops/l | 40 drops/l |

The last two columns show the composition of the two separate parts used for the two stage development. These are added in the ratio 12.5/1.5 so that the developer has the same composition as the single part developer shown in column 2. In process 2, 14 ml of the single part developer was added at a rate of 14 ml per linear foot of 35 mm film. In fact the film was processed in the form of 1 foot long 35 mm strips and 14 ml of the single part developer was added as the processor was rotating. After 30 seconds, 4 ml of stop bath was then added to the developer and after another 30 seconds the solution was removed and the bleach solution was added. The bleach solution was removed after 3 minutes 30 seconds and the fix solution was added. The fix was removed after 3 minutes 30 seconds and the strip removed from the processor and washed for two minutes in a wash tower with freely flowing water. Throughout this time the processor was rotating and agitation was provided by means of a roller as described above with reference to FIG. 1. In process 1, 12.5 ml of part 1 of the developer was added as the drum was rotating and 5 seconds afterwards 1.5 ml of part two of the developer was added. After a total time of 30 seconds the stop bath was added and the process was then the same as process 2. The single development (process 2) and the two stage development (process 1) were compared according to the process cycles in Table 1 at 60° C. The results with an experimental 400 ISO color negative film are shown in Table 3 and Table 4.

TABLE 3

Single part development (process 2)

| | R | G | B |
|---|---|---|---|
| Dmin | 0.147 | 0.643 | 0.96 |
| Dmax | 0.85 | 1.61 | 2.55 |
| Gamma | 0.34 | 0.44 | 0.61 |
| BFC | 0.29 | 0.4 | 0.6 |
| KitSpd | 342.38 | 337.06 | 340.45 |
| Spd0_2 | 281.94 | 307.41 | 316.27 |
| Inspd | 337.12 | 351.06 | 342.14 |

TABLE 4

Two part development (process 1)

| | R | G | B |
|---|---|---|---|
| Dmin | 0.180 | 0.664 | 1.06 |
| Dmax | 1.09 | 2.06 | 2.7 |
| Gamma | 0.48 | 0.61 | 0.64 |
| BFC | 0.45 | 0.57 | 0.62 |
| KitSpd | 344.40 | 337.98 | 339.52 |
| Spd0_2 | 293.63 | 317.39 | 316.03 |
| Inspd | 325.09 | 343.72 | 337.44 |

It can be seen from Tables 3 and 4 that the photographic performance of the two part development is superior to that of the one part development. The parameters are as follows; Dmin=minimum density including masking dyes, Dmax is the maximum density at the highest exposure given, Gamma is the point contrast, BFC is the best fit contrast, KitSpd, Spd0_2 and Inspd are three different photographic speed measures. For short development times such as 30 seconds it is usually found for films designed for the standard C-41 development time of 3 minutes 15 seconds that the red and green contrasts are lower than the blue. This can be seen for the single part development in Table 3, the Gamma and BFC parameters are low for the red and green compared with the blue. In fact the red contrast is about 50% of the blue and the green contrast is about 67% of the blue. In Table 4 the two stage development has much higher red and green contrasts; in this case the green is 90–95% of the blue and the red is 72–75% of the blue. Thus the two stage development shows a significant improvement over the single part development yet the total process time is the same and the total amount of developer chemicals used is the same.

It was also observed that the uniformity of the two stage development was excellent and so mixing of two component parts directly into the dry processing tank onto dry film is a viable method.

The two component parts as used in the two stage development are stable for long periods of at least 1 year. A pre-mixed developer as used in the single part development (process 2) is stable only for a few weeks.

The developer component parts could be separated into more than two partial stages. In this case the development stage could be more than two partial stages. Two or more of the component parts could be mixed in the processing tank or mixed before adding to the processing tank. The method of using more than one partial stage for a given overall stage of a processing cycle can be extended to other processing stages such as the bleach, fix, bleach-fix and stabilizer or to any other stage of a process. The method can be used for color negative, color reversal, black and white, film or paper processing. Although the method has been described as used in an apparatus as shown in the drawings the method is not limited to use in such a processor.

EXAMPLE 2

This is an example of the invention.

The developer in Table 5 was made as a single part.

TABLE 5

| Developer composition | |
|---|---|
| Component | Concentration |
| $Na_3PO_4.12H_2O$ | 50 g/l |
| DEHA | 5 ml/l |
| KBr | 8 g/l |
| $Na_2SO_3$ | 2 g/l |
| CD4 | 10 g/l |
| Tween 80 | 10 drops/ |
| pH | 12.0 |

This developer was used at 14 ml/linear foot of 35 mm film in the process cycle shown in Table 6.

TABLE 6

| Process cycle | | |
|---|---|---|
| Develop | 30 sec | 14 ml/linear foot of 35 mm |
| Stop | 20 sec | 4 ml/linear foot of 35 mm |
| Bleach | 3 min 30 sec | large tank(2 liters) |
| Fix | 3 min 30 sec | large tank(2 liters) |
| wash | 2 minutes | |

where the stop was 10% acetic acid, the bleach was Kodak Flexicolor Bleach III NR and fix was Kodak Flexicolor C-41b Fixer.

The same developer was also made from two parts as shown in Table 7.

TABLE 7

| Two part developer(B) | | |
|---|---|---|
| Component | Part(1) | Part(2) |
| $Na_3PO_4.12H_2O$ | 53.8 g/l | — |
| DEHA | 5.38 ml/l | — |
| KBr | 8.6 g/l | — |
| $Na_2SO_3$ | 2.15 g/l | — |
| $Na_2S_2O_5$ | — | 7 g/l |
| CD4 | — | 140 g/l |
| Tween 80 | 11 drops/l | 1 drop/l |
| pH | 12.2 | — |

where; DEHA is diethylhydroxylamine, CD4 is 4-amino-3-methyl-N-ethyl-N-(β-hydroxyethyl)aniline sulfate, Tween 80 is a commercially available polyoxy ethylene surfactant.

These two parts are used with 13 ml/linear foot of 35 mm film of Part (1) and 1 ml/linear foot of Part (2). Part (1) was added first and after 5 seconds ($t_1$) part (2) was added and the development was continued for a further 25 seconds ($t_2$) to give a total development time of 30 seconds.

Figure 2:
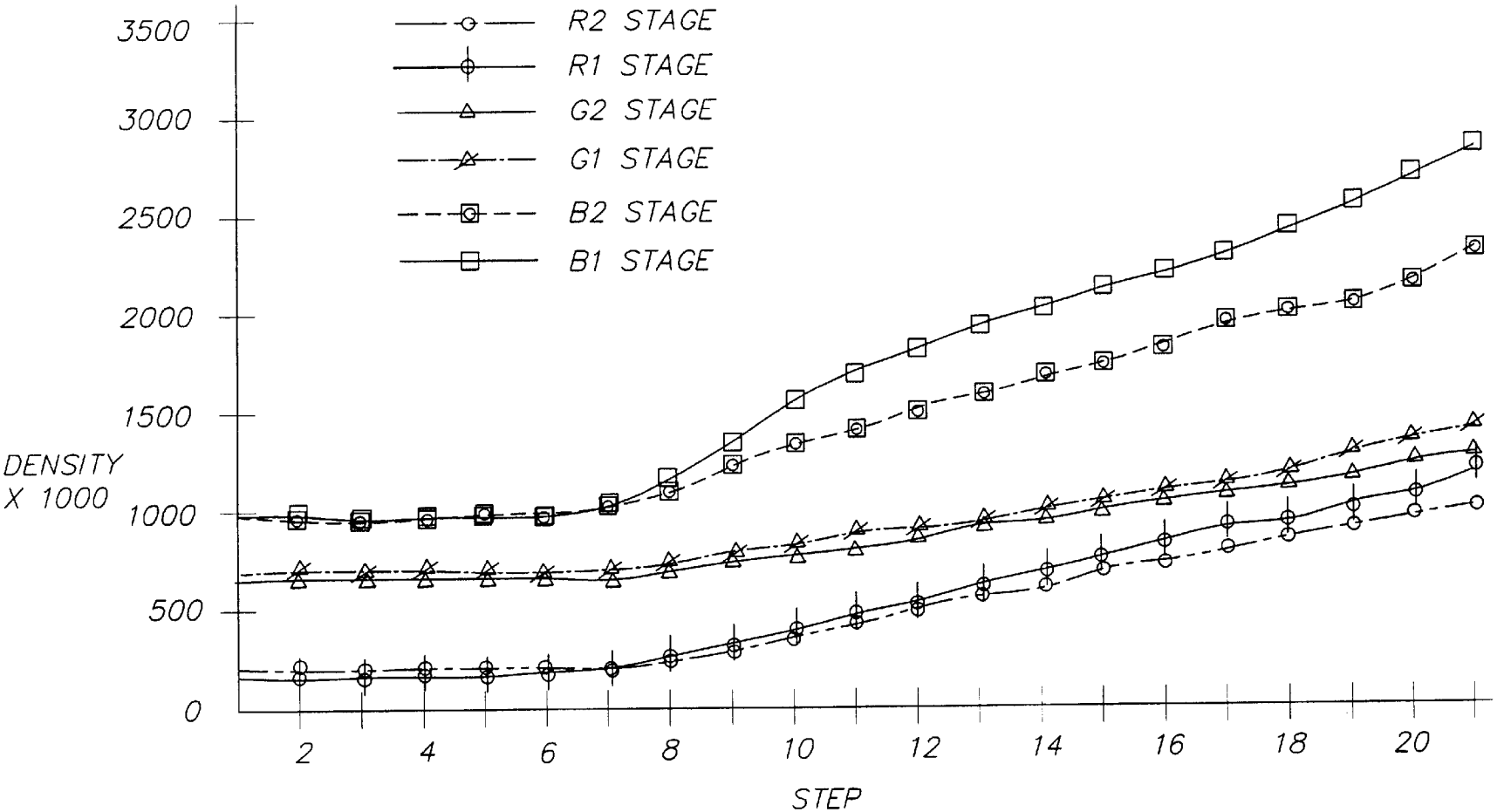
FIG. 2 is a graph comparing the method of the invention with a reference process.

A comparison between one part and two part development is shown in FIG. 2. Here it can be seen that the two stage development is an improvement over the single stage development. Over-development in the blue layer is prevented, the red layer is more active and the red and blue layers are more similar in contrast compared to the single development case. Thus the invention has been demonstrated.

The invention has been described in detail with reference to certain preferred embodiments thereof. It will be understood by those skilled in the art that variations and modifications can be effected within the scope of the invention.

PARTS LIST

1 cylinder
2 drive shaft
3 arm
4 film cassette
5 film
6 slot
7 flange
8 syringe
9 reservoir
10 roller
21 arm

What is claimed is:

1. A method of processing photographic material comprising the steps of applying a fixed volume of at least one of the processing solutions to the surface of the material such that the volume is spread and re-spread repeatedly over a given length of material in a rotating containment chamber, the fixed volume being applied in at least two stages, in the first stage the first volume is spread repeatedly by the formation of a standing wave of solution, in the second stage the second volume is added to the standing wave so as to mix coherently with the first volume, each stage lasts for a predetermined time period.

2. A method as claimed in claim 1 wherein the developer solution is applied in two stages.

3. A method as claimed in claim 2 wherein the solution applied in the first stage does not contain color developing agent and the second stage does contain color developing agent.

4. A method as claimed in claim 1 wherein the ratio of the volumes of the solution applied in the first and second stages is variable.

5. A method as claimed in claim 1 wherein the solution is agitated as it is applied to the surface of the material.

6. A method as claimed in claim 1 wherein the time, $t_1$, between the addition of the first stage of the processing solution and the addition of the second stage of the processing solution is between 0.1 to 195 seconds.

7. A method as claimed in claim 6 wherein the time, $t_1$, is between 2 to 60 seconds.

8. A method as claimed in claim 6 wherein the time, $t_1$, is between 5 to 15 seconds.

9. A method as claimed in claim 1 wherein the time, $t_2$, between the addition of the second stage of the processing solution and the next processing solution is between 0.1 to 195 seconds.

10. A method as claimed in claim 9 wherein the time, $t_2$, is between 2 to 60 seconds.

11. A method as claimed in claim 9 wherein the time, $t_2$, is between 5 to 15 seconds.

12. A method as claimed in claim 1 wherein the total volume of the first and second stages is 0.1 to 20 ml/linear foot (0.33 to 66 ml/linear meter) of 35 mm film.

13. A method as claimed in claim 1 wherein the volume per linear foot of 35 mm film of the first stage is more than the volume per linear foot of 35 mm film absorbed by the film.

14. A method as claimed in claim 1 wherein the method is carried out in an apparatus comprising; a chamber adapted to hold photographic material therein, means for introducing a metered amount of solution into the chamber, means for removing the solution from the chamber, means for rotating the chamber and means for sweeping the surface of the material at each rotation of the chamber, thereby to form a wave in the solution through which the material may pass.

15. A method as claimed in claim 1 wherein a proportion of the first stage of the processing solution is used to neutralize the second stage of the processing solution upon addition to the processing chamber such that the pH of the mixture of the first and second stages is between 5 and 9.

16. A method as claimed in claim 15 wherein the remainder of the first stage is added to the neutralized mixture of the proportion of the first stage and the second stage.

17. A method as claimed in claim 1 wherein there are more than two solution stages for a given process stage.

18. A method as claimed in claim 1 wherein after addition to the chamber the first stage of the processing solution forms a wave of solution to which is added the second stage.

* * * * *